United States Patent [19]

Baker, Sr.

[11] 4,230,171

[45] Oct. 28, 1980

[54] DRAPERY PLEATING APPARATUS AND METHOD

[76] Inventor: George H. Baker, Sr., R.R. #1, Dunlap, Ill. 61525

[21] Appl. No.: 16,282

[22] Filed: Feb. 28, 1979

[51] Int. Cl.[3] ..... A47H 5/00; E06B 3/94

[52] U.S. Cl. ..... 160/84 R; 160/327; 160/345; 160/368 R

[58] Field of Search ..... 160/84 R, 115, 123–126, 160/327–330, 345–348, 368 R

[56] References Cited

U.S. PATENT DOCUMENTS

| | | | |
|---|---|---|---|
| 604,329 | 5/1898 | Judge | 160/115 |
| 2,234,685 | 3/1941 | Vance | 160/84 R |
| 2,559,072 | 7/1951 | Hasselwander | 160/348 |
| 2,779,405 | 1/1957 | Hess | 160/348 |
| 3,055,419 | 9/1962 | Rubin et al. | 160/84 R |
| 3,132,686 | 5/1964 | Judovits | 160/348 |
| 4,165,779 | 8/1979 | Jacobs | 160/348 |

*Primary Examiner*—Peter M. Caun

*Attorney, Agent, or Firm*—Wegner, Stellman, McCord, Wiles & Wood

[57] ABSTRACT

A drapery, a supporting apparatus for said drapery, and a method of making a pleated drapery is provided. The drapery is provided with a structure for pleating the drapery in a pattern as it is moved out of a window covering position. The pleater structure includes a backing member attached to a plurality of spaced apart stiffening members. The pleater structure is attached to at least the top portion of the drapery. Fasteners are provided on each stiffening member for attaching the drapery to sliding carriers in a track on a support channel. Each end of the drapery is secured to appropriate sliding carriers and have friction members engaging with the track to arrest free movement of the drapery relative to the track. The vertically hinged stiffening members provide pleats in the drapery when the ends of the drapery are moved closer together. In one modification, a restrainer is provided between the fasteners to provide varying degrees of fullness to the drapery by preventing the stiffening members from becoming flat.

20 Claims, 10 Drawing Figures

FIG. 4
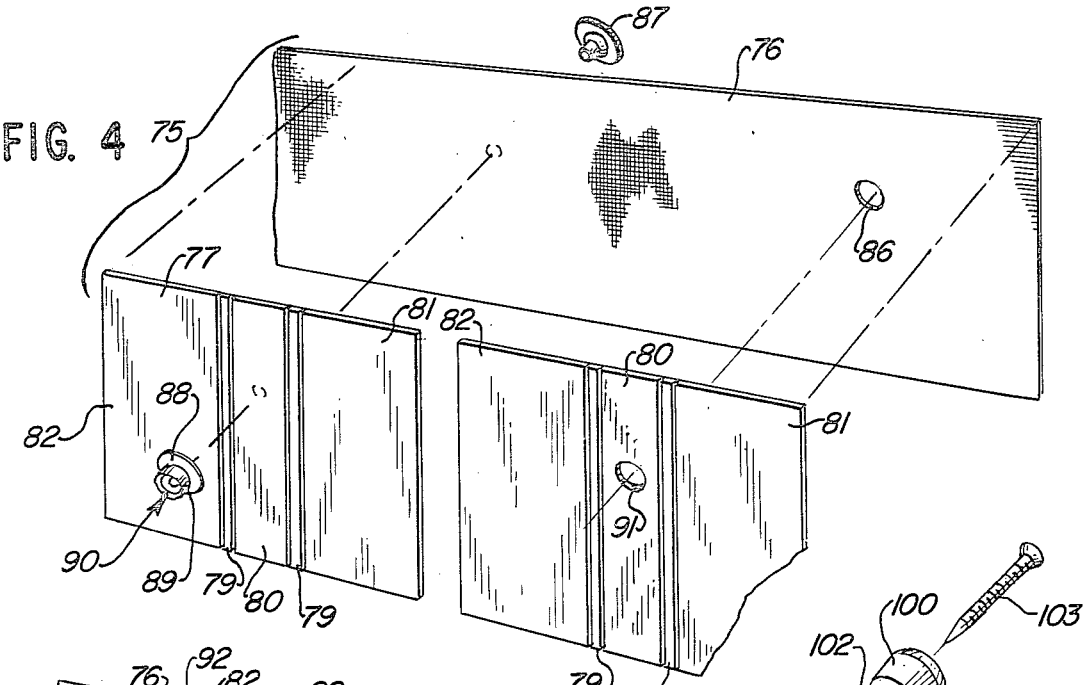
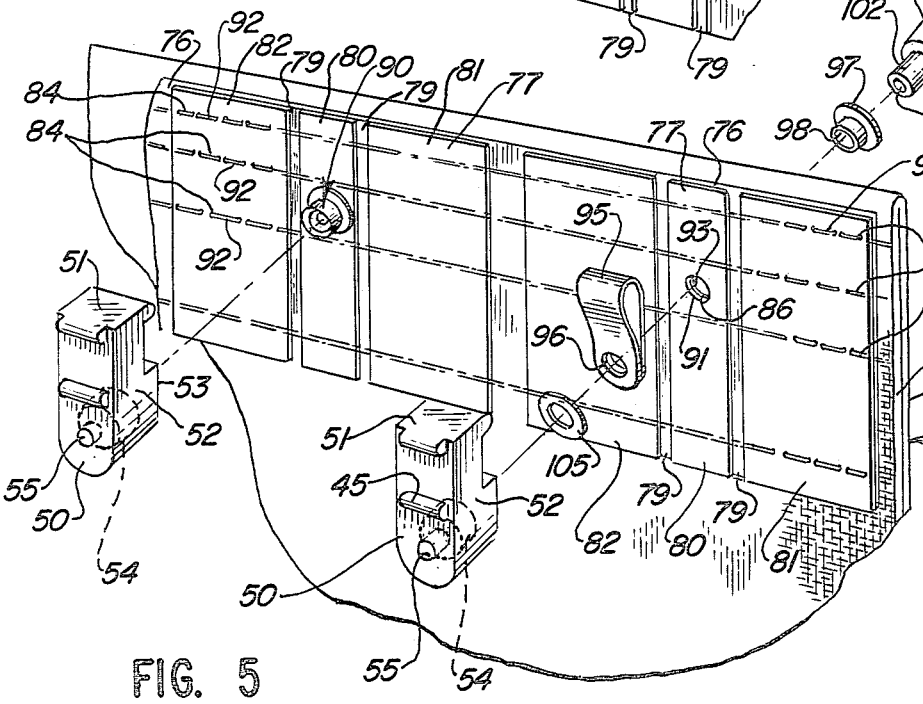
FIG. 5

DRAPERY PLEATING APPARATUS AND METHOD

BACKGROUND OF THE INVENTION

1. Field of the Invention

This invention relates to draperies and, more particularly, to a pleated drapery and the combination thereof with a track and slider and to a method of making a pleated drapery.

2. Description of the Prior Art

Heretofore, many different systems have been used to suspend a drapery from a track and, in particular, to pre-pleat the drapery so that in the open, stacked back position, the drapery will assume a predetermined pleated state. Some draperies have pleats stitched in the upper edge portion, which pleats are always present whether the drapery is fully opened or closed.

Another prior pleating arrangement is provided with a plurality of interfitting articulated members which are attached to the drapery and will move into a pleating state for the drapery, as the drapery is moved from the fully closed position toward the open, stacked back position. In the closed position, the drapery can be completely flat without pleats being formed therein. Other structures are available for attachment to the drapery to provide the appearance of pleats in the drapery as the drapery is moved to the open, stacked back position.

The stitching form of pleating and the interfitting link form of pleating have certain disadvantages. The stitched-in permanent pleating requires the use of extra material to construct permanent pleats. The added material adds weight to the drapery and to the track, and is difficult to clean. The interfitting link form of drapery pleating necessitates allowing space for the articulated links so that in the open, stacked back position of the drapery, the links abut each other to hold the drapery material in a relatively loose condition and prevents completely opening the drapery. In addition, it is not possible to scale down the size of the links so as to provide a pleating arrangment using the links in a relatively small application, such as for train windows, airplane windows, and the like.

SUMMARY OF THE INVENTION

All of the above noted disadvantages are eliminated by my improved drapery pleating and drapery hanging arrangement.

A pleater structure is provided directly on the back side of the drapery, which pleater structure is comprised of a backing to which is secured a plurality of vertically hinged stiffening members, a fastener passes through each stiffening member for use in attaching the drapery to sliding carriers depending from a track mounted above a window opening. A braking device is carried by each end stiffening member and is adapted to engage with the track so as to resist free movement of the drapery along the track. Handles may be secured through the fabric, through the backing member, through the stiffening member and into a sliding carrier on the track. The stiffening members are divided into hinged together parts, such that each stiffening member, when folded, will produce a pleat in the drapery.

In one embodiment, a retainer is secured to the snap fasteners so as to provide varying degrees of fullness to the drapery by retaining the drapery always in the condition of having pleats therein, even when the drapery is fully closed.

An improved method of making a drapery is also disclosed.

BRIEF DESCRIPTION OF THE DRAWINGS

The details of construction and operation of the invention are more fully described with reference to the accompanying drawings which form a part hereof and in which like reference numerals refer to like parts throughout.

In the drawings:

FIG. 4 is a partial exploded view of a backing member and a pair of stiffening members which, when assembled, will make up a pleater structure for two adjacent pleats;

FIG. 5 is a perspective view of a part of a drapery with a pleater structure assembled therewith and with the sliding carriers detached from the drapery;

DESCRIPTION OF THE PREFERRED EMBODIMENT

Figure 1:
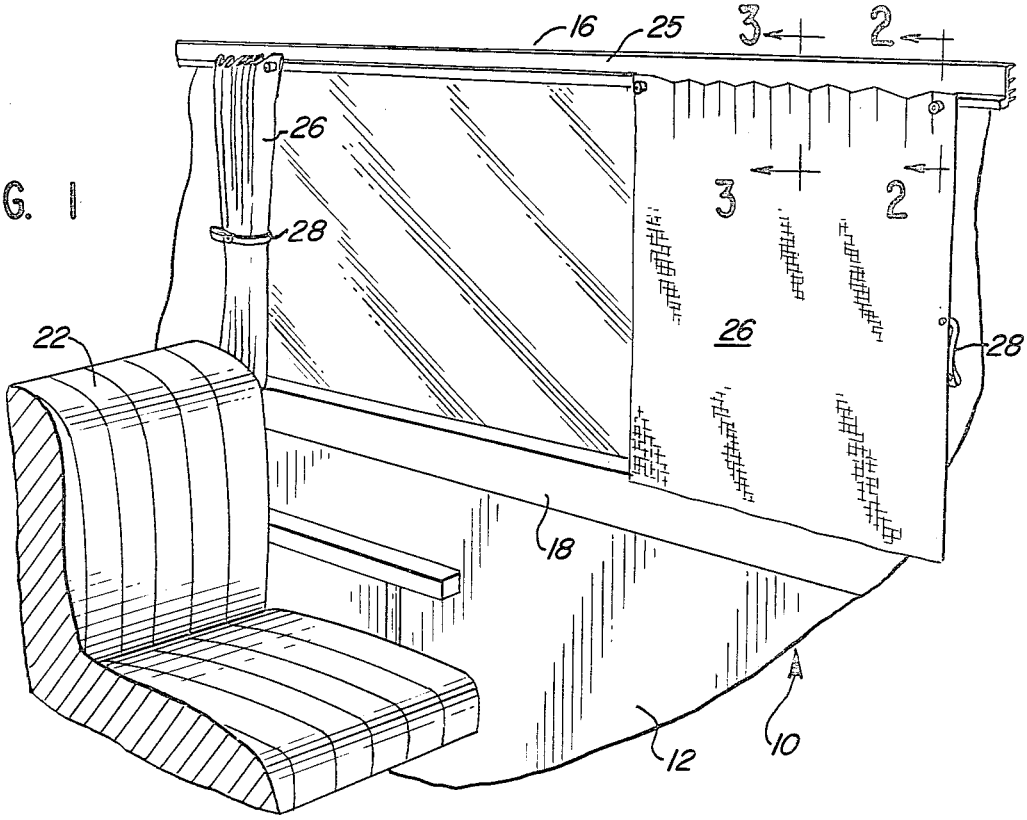
FIG. 1 is a perspective view of a window in a vehicle, such as a railroad car, having a pair of improved draperies suspended thereon.

Referring to the drawings, a vehicle 10 has a side wall 12 which has an elongate window 14 bordered above and below, respectively, by a frame 16 and 18. The window 14 may be an individual window for each seat 22 or may be a continuous window extending along side two or more seats. As illustrated in FIG. 1, a drapery suspending channel member 25 is affixed to the frame 16 above the window 14 and supports one or more hanging draperies 26. As illustrated, the draperies 26 are suspended from the channel member 25 at the upper portion of the drapery. It is to be understood that a second channel member (not shown) could be mounted on the lower frame 18 of the window to which the bottom of the drapery could be assembled. In this way, the drapery would not be free to swing to and from the window. Each drapery 26 has a tieback member 28 which can be wrapped around the drapery and buttoned in place to hold the drapery in the open, stacked back, fully pleated position.

The channel member 25 for suspending the drapery 26 can be any one of many types available. A preferred channel is illustrated and is formed of an extruded plastic or metal, such as aluminum. The channel 25 has a vertical body portion 30 shaped on the top 31 and on the bottom 32 in a way as to facilitate snapping into a plurality of spaced apart spring clips 34 which are screwed at 36 to the frame 16 above the window. A shield 38 is formed integrally with the body 30 of the channel 25 and extends upwardly from the top 31 to keep the spring clips 34 out of view and to provide a continuous appearance to the channel. The body portion 30 of the channel 25 has an integrally formed outwardly extending horizontal wall 40 and a downwardly extending wall or skirt 41 carried by said wall 40. The skirt 41 is spaced from a portion 42 of the body 30 to form a downwardly opening track 44. The track 44 has an open center portion with one pair of inwardly projecting, aligned shoulders 46 vertically spaced from a second pair of inwardly projecting, aligned shoulders 48. The shoulders 46 form supports and the shoulders 48 form guides for a plurality of sliding carriers 50. The outer face of wall or skirt 41 of the channel 25 extends vertically downward and slightly inward so as to produce a stylized appearance when viewed with the drapery 26 in the open, stacked back position.

Figure 3:
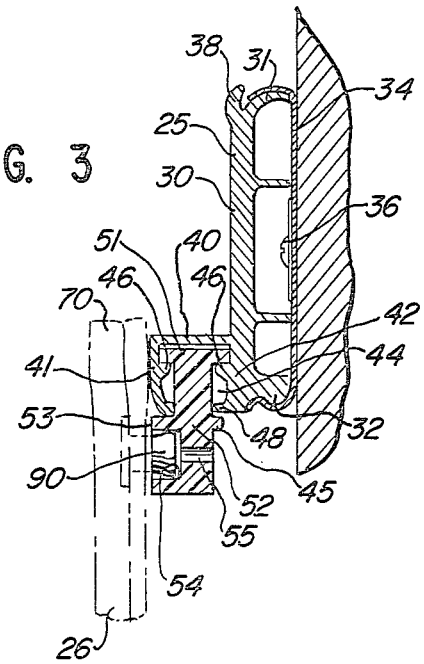
FIG. 3 is a cross-sectional view taken along the line 3—3 of FIG. 1.
Figure 2:
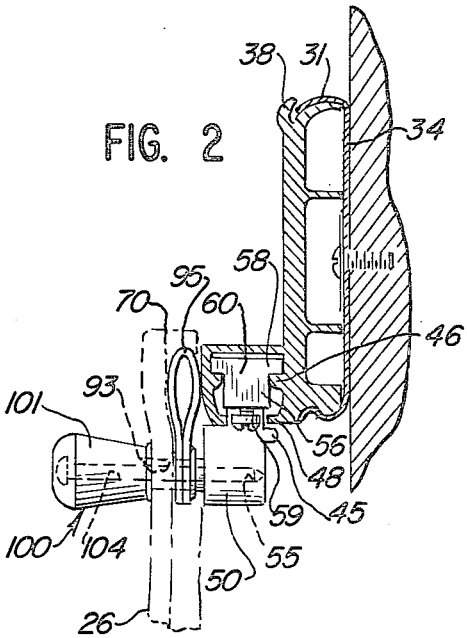
FIG. 2 is a cross-sectional view taken along the line 2—2 of FIG. 1.

The sliding carriers 50, as shown in FIG. 3, are suspended from the track 44 and have a T-shaped head portion 51 with the overhang of the "T" engaging between the support shoulders 46 and the wall 40 so as to trap the sliding carriers 50 in the track 44 and to permit movement of the sliding carriers 50 along the track. A downwardly depending portion 52 of the sliding carrier 50 is thick enough to be slightly engaged by the inwardly extending shoulders 48 at the mouth of the opening in the track 44 so as to stabilize movement of the sliding carrier 50 and prevent wobbling of the sliding carriers toward and away from the window 14. A rib 45 is integrally formed on the carrier 50 and extends rearwardly below the shoulders 48 to further guide the carrier in the track. The portion 52 of the carrier 50, extending below the skirt 41, has a planar surface 53 facing away from the channel 25 and has an undercut bore 54 formed in said surface 53. A reduced diameter opening 55 extends from the bottom of the bore 54 in carrier 50 through the portion 52. So as to limit the movement of the drapery 26 along the channel 25, T-shaped end stops 56 (FIG. 2) are provided. The head 58 of the "T" rests on the shoulders 46 with a screw 59 extending up the leg 60 of the "T" and bearing against the underside of the wall 40 to secure the head 58 of the "T" against the shoulders 46 in the track 44 which will prevent the sliding carriers 50 from being moved beyond a predetermined point. It is contemplated that one end stop 56 could be formed integrally with one end sliding carrier 50 which would be used to lock the one end of the drapery 26 to the track 44 in a fixed position. The attachment of the combined end stop 56 and sliding carrier 50 would be the same, namely a screw 59 passing up through the end stop 56 to engage the wall 40 of the track 44 and urge the head 58 of the "T" into engagement with the shoulders 46 in the track.

The drapery 26 is comprised of a sheet of fabric material 70 and a pleater structure 75 fastened to the fabric along the top edge portion thereof. The fabric 70 may be a decorative sheet of material 71 having a pattern, or the like, on the outer surface and a lining sheet of material 72 on the inner surface thereof, which sheets 71,72 are joined together along the edges. The pleater structure 75 is comprised of a backing member 76 and a stiffening member 77. The backing member 76, in the illustrated form, is comprised of a band of scrimmed material of plastic and fiber with the fiber being embedded in the plastic to act as a flexible backing for the top edge portion of the drapery 26 and for the stiffening member 77. One typical material for the backing member 76 is sold under the tradename HERCULITE.

A plurality of horizontally spaced apart stiffening members 77 are provided, each stiffening member 77 being made of, for instance, an extruded vinyl material and having a pair of parallel, vertically oriented hinges 79 formed therein by means of the die as the member is being extruded. An elongate strip of material with the hinges 79 therein is extruded and is then cut along a line transverse to the hinges to form individual stiffening members 77. As shown in FIG. 4, the stiffening members 77 have a center portion 80 which is hinged at 79 on each side to a pair of wing portions 81,82, which wing portions 81,82 are wider than the center portion 80. The stiffening members 77 are placed on the backing member 76 with a short horizontal space between the wing portions 81 and 82 of the adjacent stiffening members 77. By the use of dielectrics, or the like, the stiffening members 77 are attached to the backing member 76 along spaced apart horizontal dashed lines 84 to form the pleater structure 75. The portion of the backing member 76 between adjacent stiffening members 77 acts as a hinge between said stiffening members 77. The dashed attaching lines 84 serve as guide lines. In each of the stiffening members 77, except the two end ones, a male post 87 is driven through the backing member 76 and the midportion of the center portion 80 of the stiffening members 77 into a female snap portion 88 to form an eyelet 90.

The pleater structure 75, made up of the backing member 76 and the plurality of spaced apart stiffening members 77, is then laid up on the back of the fabric material 70 along the top edge portion thereof. The pleater assembly is then attached to the fabric at four vertically spaced apart horizontal lines 92. Where the material of the drapery is a fabric, the attachment is by means of stitching, which stitching follows the dashed horizontal lines 84 as guides. The stitching eliminates the dashed lines 84. In the event that the material of the drapery is a vinyl, or the like, no backing member 76 is needed and the stiffening members 77 are attached to the vinyl by the use of dielectrics, or the like. Each end of the pleater structure 75 has an aperture 93 cut through the fabric 10 in alignment with both an aperture 86 in the backing member 77 and an aperture 91 in the stiffening member 77. A brake member 95, comprised of a loop-shaped plastic material, such as a polypropylene or polyethylene, has aligned apertures 96 cut through the mating end portions thereof. The brake member 95 is attached to one or both end stiffening members 77 with the apertures 96 in alignment with the aperture 91 in the stiffening member 77, aperture 86 in the backing member 76, and the aperture 93 in the fabric 70. A grommet 97 is passed through the aligned apertures 93,86,91,96 and through the opening in washer 105 and is crimped to the material surrounding said opening in the washer 105 to affix a brake member 95 to one or both end stiffening members 77. The grommets 97 have an opening 98 extending therethrough. It is to be understood that a brake could be attached to any stiffening member 77 using the post 87 in place of the grommet and using snap 88 in place of the washer.

The drapery 26 with the pleater structure 75 and one or more brakes 95 attached thereto is now ready for assembly with the sliding carriers 50 on the channel 25. A handle 100 is provided for one or both end portions of the drapery 26 and includes an enlarged body member 101 having a reduced diameter axially extending sleeve 102 integrally formed therewith. A screw 103 having a head 108 recessed in the body member 101 passes through an opening 104 extending the length of the body member 101 and the sleeve 102. The reduced diameter sleeve 102 is inserted in the opening 98 in the grommet 97 from the decorative or front side of the fabric 70 and extends into the bore 54 in the carrier 50. The screw 103 in the handle 100 is threaded into the opening 55 in the sliding carrier 50. The opening 104 in the handle 100 and sleeve 102 is of a size relative to the screw 103, such that the handle 100 can pivot about the screw 103 without loosening the screw. In this way, the handle 100 and the drapery 26 cannot be removed from the sliding carrier 50 without using an appropriate screwdriver. This prevents stealing the drapery and the handle. It is to be understood that the handles 100 are not an essential feature, in that the screw 103 could secure the end stiffening members 77 to the carrier 50 and have the head 108 of the screw 103 nested in the grommet 97 so as to prevent removal of the screw.

The drapery 26 is designed for minimum projection away from the window or wall. In one application, the projection was limited to under two and one-half inches using my improved pleater structure, and since the drapery is to be used in vibrating moving vehicles, the brake 95 was provided to prevent the drapery from walking along the channel.

In attaching the handle 100 and the end portions of the drapery 26 to the end sliding carriers 50, the brake 95 has the loop urged against the outer face of the skirt 41 of the channel 25 which will somewhat collapse the loop. The urging of the loop against the track 44 will add resistance to movement of the drapery 26 and sliding carrier 50 along the track 44 in the channel 25. The material used to make up the brake 95 is such as to have a memory and to have a lubricant-type surface such as not to scratch or mar the finish on the skirt 41 of the channel.

The remaining eyelets 90 associated with the stiffening member 77 between the endmost stiffening members are snapped into the undercut apertures or bores 54 in the sliding carriers 50 with one sliding carrier 50 for each eyelet 90. The body 52 of each carrier 50 is of a size and shape as to fit in the track 44 in a sturdy fashion such that each eyelet 90 can be snapped into bore 54 using only pressure from the thumb or finger of the installer. It is not necessary to use a second hand behind the carrier to back the carrier when the eyelet is snapped into place. The drapery 26 is now suspended from the track 44 in the channel 25 and upon applying pressure to one handle 100, or to one end of the drapery, said one end of the drapery is moved toward the other end whereupon the pleater structure 75 will form a plurality of uniform pleats along the length of the top portion of the drapery. That is, each stiffening member 77 will have the center portion 80, which is attached to the eyelet 90 and to the sliding carrier 50, form the root or base of each pleat with the wings 81,82 of each stiffening member 77 forming the sloping side walls of adjacent pleats. The crest of each pleat is formed by the backing material that bridges the gap between adjacent stiffening members 77,77.

Figure 6:
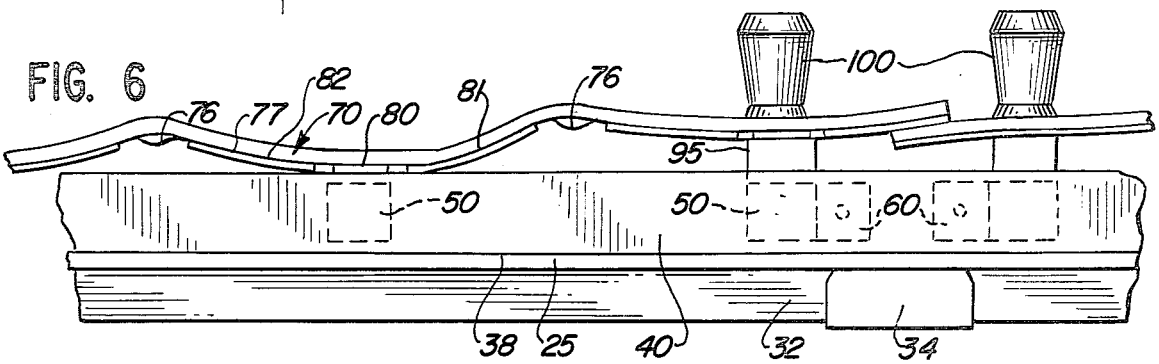
FIG. 6 is a top plan view of a portion of a track and a drapery, and the drapery almost flat.
Figure 7:
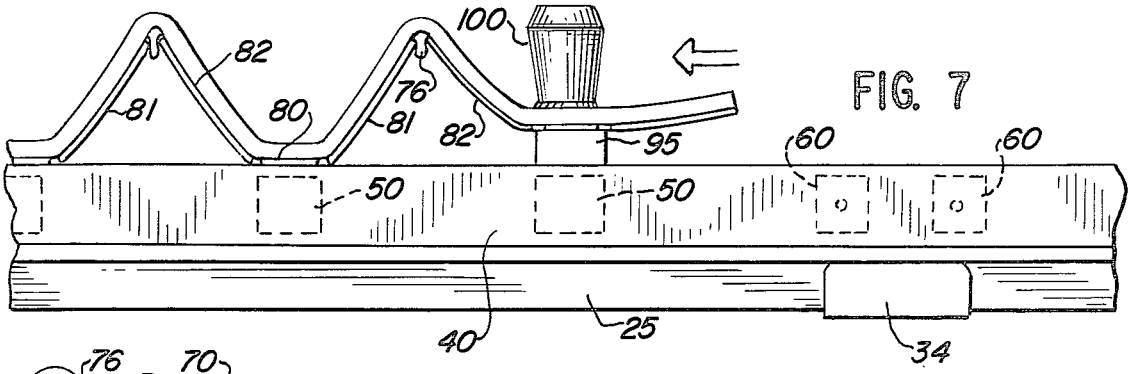
FIG. 7 is a top plan view similar to FIG. 6 only with the pleats in the drapery more completely folded.
Figure 8:
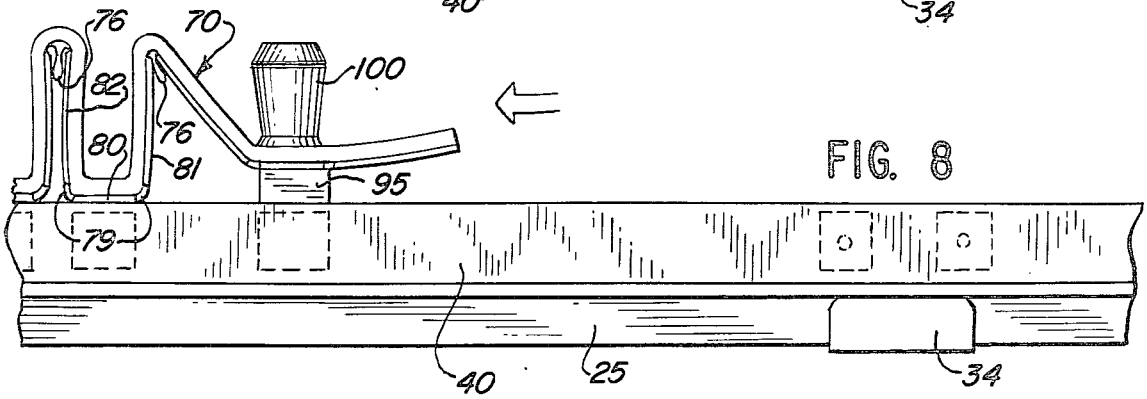
FIG. 8 is a top plan view similar to FIGS. 6 and 7 only with the pleats in the drapery completely folded and showing both ends of the drapery.

FIG. 6 illustrates the top view of a drapery 26 with the pleats just beginning to form and the crest of adjacent pleats being spaced a greater distance from the track 44 than the roots of the pleat. FIG. 7 shows the pleats substantially formed with the crests spaced a considerable distance from the track 44 and the hinges 79 between the center portion 80 and wing portions 81,82 of each stiffening member 77 being about half flexed. FIG. 8 shows the drapery 26 substantially fully open or stacked back with each pleat relatively tight and the wings 81,82 of each stiffening member 77 lying substantially parallel to each other. The brakes 95 at each end stiffening member 77 holds the drapery 26 in the pleated position until one end of the drapery is urged away from the other end of the drapery to expand the drapery until it is substantially flat. As shown in FIG. 6 with the drapery substantially closed, the one wing 82 of the end stiffening member 77 projects beyond the attachment of the stiffening member to the carrier. The wing 82 serves as the overlap for a master-type slide such that a wing 81 of an adjacent drapery extends either behind or in front of the wing 82 so as to effect an overlap flap for completely closing the drapery.

Figure 9:
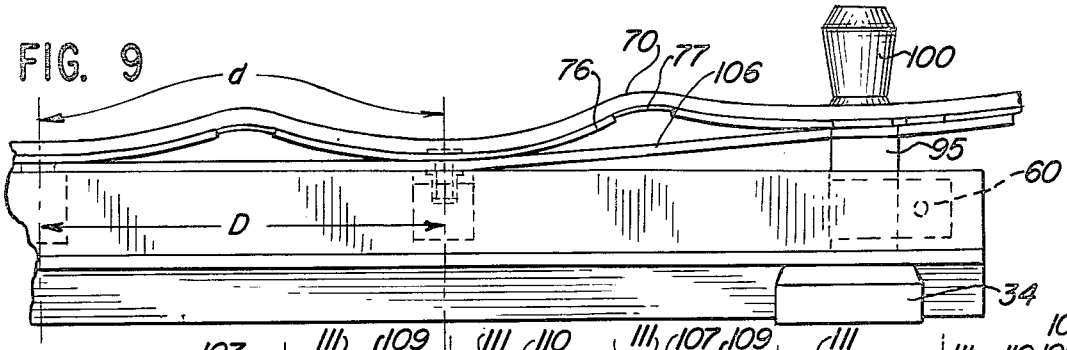
FIG. 9 is a top view of a modified form of the invention.
Figure 10:
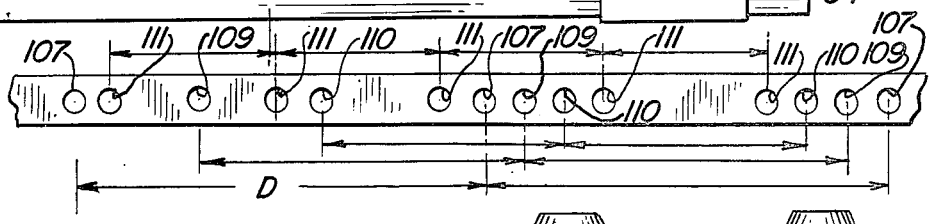
FIG. 10 is a partial elevational view of a retainer for use in the modification of FIG. 9.

FIGS. 9 and 10 show a modified form of the invention wherein FIG. 10 shows a restrainer strip 106 which has a plurality of spaced apart apertures 107,109,110,111 of a size substantially conforming to the outside diameter of the male stud 89 of the eyelet 90. The distance D between the center lines of apertures 107 in the restrainer 106 is less than the distance d between adjacent eyelets 90 when the drapery is completely flat. The apertures 107 of the restrainer strip 106 are snapped over the eyelets 90 of the drapery 26 and over the reduced diameter sleeves 102 at the end portions of the drapery which will create a fullness or permanent pleats between adjacent eyelets 90 and between eyelets 90 and the reduced diameter sleeves 102. As shown in FIG. 9, the restrainer strip 106 is stretched straight, but since the eyelets 90 are not fully expanded with respect to each other, the wings 81,82 of adjacent stiffening members 77 are out of the plane of the center portion 80 to form permanent pleats with the crest of the pleat spaced from the restrainer strip 106 a predetermined amount or with a predetermined degree of fullness. When no strip 106 is used, the drapery 26 will have a 0% fullness when closed. Using the strip 106, an infinite range of fullness can be created depending on the spacing between the apertures in the strip. To get a full range of fullness from 0% to 100%, the spacing between the apertures vary from d equal to D (no strip) to $D=\frac{1}{2}d$. The spacing between the set of apertures 107 provides a 25% fullness, between the set of apertures 109 provides a 50% fullness, between the set of apertures 110 provides a 75% fullness and between the set of apertures 111 provides a 100% fullness. The strip 106 is coded, for instance, it may have the edges of the apertures or the area around the apertures color coded so as to make it easy to identify the degree of fullness being selected. The strip 106 can be made of a thin material such as a plastic sold under the trademark MYLAR.

Either one strip 106 with plural sets of apertures for plural fullness settings can be supplied, or an individual strip 106 with one predetermined degree of fullness therein can be supplied.

As suggested hereinabove, it is possible to have a pleater structure 75 along the bottom edge of the drapery 26 as well as along the top edge, in which case, a second channel member 25 would be mounted along the lower frame 18 of the window 14 so that the drapery 26 would not be free to swing about the top edge thereof. In this way, in order to open or close the drapery, the one end of the drapery is pushed toward or pulled away from the other end either by using the handles or by grasping the drapery to open or close the drapery.

The loop-shaped brake members 95 mounted between the handles 100 and the channel 25 on each end of the drapery 26 bears against the skirt 41 of the channel so as to add resistance to movement of the ends of the drapery relative to the track 44. Since the loop-shaped brake members 95 are generally of plastic material having a memory and non-abrasive properties, they will slide relative to the track without marring or abrading the track. The brake will move under pressure applied parallel to the track, but without the applied pressure, the friction between the brake 95 and the channel 25 is sufficient to prevent the drapery 26 from moving freely or walking along the track 44. That is, in a moving vehicle, such as a railroad train, the vibration of the vehicle will cause loose articles, such as a free hanging drapery, to walk along its suspension track. The brakes 95 are provided to eliminate the walking of the drapery. With the brake, it is necessary to apply some force to the handle 100 to break the friction between the brake member 95 and the track 44 loose whereupon the drapery 26 can be opened and closed as desired.

I claim:

1. A drapery made of a sheet of material, a backing strip, a plurality of stiffening members attached to said backing strip in spaced apart relationship, a fastener extending from some of said stiffening members, said backing strip and plural stiffening members being secured to said sheet of material near at least the upper edge portion thereof with said fasteners projecting rearwardly therefrom, and brake means attached to at least one stiffening member.

2. A drapery as claimed in claim 1 wherein at least one grommet is attached through said material, said backing strip and one of said stiffening members.

3. A drapery as claimed in claim 2 wherein each stiffening member is divided into three parts by vertically extending hinges, and wherein said fasteners and said grommet pass through the middle part of the three parts of said stiffening members.

4. A drapery as claimed in claim 3 wherein one grommet passes through the two outermost stiffening members and attaches one of said brake means to said two outermost stiffening members.

5. A drapery and a support structure comprising a sheet of material, a narrow backing strip, a plurality of stiffening members attached to said backing strip in spaced apart relationship, a fastener carried by each stiffening member intermediate the two endmost stiffening members, said backing strip and plural stiffening members being secured to said sheet of material near at least the upper edge portion thereof, brake means carried by the two endmost stiffening members, a support structure having a channel, and slide carriers carried by said channel to which said fasteners are attached.

6. A drapery as claimed in claim 5 wherein a grommet passes through said material, through said backing strip, through said two endmost stiffening members and through said brake means to secure said brake means to said two endmost stiffening members.

7. A drapery as claimed in claim 6 wherein a handle is provided at each end of said drapery.

8. A drapery as claimed in claim 7 wherein said handle has a sleeve portion extending through said grommet, and a threaded means extending through said handle and sleeve portion and engaging one of said slide carriers for supporting said endmost portions of the drapery and for urging said brake means into engagement with said channel.

9. A drapery as claimed in claim 8 wherein said brake means is a loop of material with the walls of the loop urged apart by the resilience of the material.

10. A drapery as claimed in claim 5 wherein each stiffening member is divided into three parts by hinge means that lie parallel to the side edges of said drapery, said three parts comprising a center portion and two wing portions with the wing portions folding relative to the center portion along said hinge means to form a pleat upon moving one end of said drapery closer to the other end.

11. A drapery as claimed in claim 6 having a restrainer strip with a plurality of apertures therethrough, said apertures being spaced apart a distance less than the distances between adjacent fasteners when said drapery is stretched flat, said restrainer strip being buttoned over said fastener to provide said drapery with a degree of fullness.

12. A drapery as claimed in claim 6 having a restrainer strip with a plurality of sets of apertures therethrough, each set of apertures having a spacing between adjacent apertures which is less than the spacing between adjacent fasteners when the drapery is stretched out flat, each set of apertures representing a different degree of fullness for said drapery when said apertures of said set of the restrainer strip are snapped over said fasteners.

13. A drapery as claimed in claim 12 wherein each set of apertures is identified by a different code which code identifies the set as representing a particular degree of fullness for the drapery.

14. A drapery as claimed in claim 13 wherein the code is a color code with a different color for a different degree of fullness.

15. A drapery and supporting structure comprising a sheet of fabric, a backing strip, a plurality of stiffening members attached to said backing strip at spaced apart locations, each stiffening member being divided into three parts along vertical hinge lines, brake means secured to the endmost stiffening members, a fastener projecting from the midportion of the remaining stiffening members, said stiffening members and backing strip being fastened to said sheet of fabric near the upper edge portion thereof, handle means mounted on said endmost stiffening members, a channel, and a plurality of slide carriers carried by said channel, said handle means being affixed securely to the two end slide carriers, said fasteners engaging in sockets in the remaining slide carriers, said brake means frictionally engaging said channel to restrain movement of said ends of the fabric, and said three parts of each stiffening member forming a threesided pleat as the ends of said fabric are brought closer together.

16. A drapery and supporting structure as claimed in claim 15 wherein means are provided on said channel for limiting sideward movement of said slide carriers.

17. A drapery and supporting structure as claimed in claim 16 wherein each endmost stiffening member has a grommet extending through the fabric and securing said brake means to said stiffening member, and said handle means extend through said grommets.

18. A drapery and supporting structure comprising a sheet of fabric, a backing strip, a plurality of stiffening members attached to said backing strip at spaced apart locations, each stiffening member being divided into three parts along vertical lines, a fastener carried by the midportion of all except at least one of said stiffening members, said stiffening members and backing strip being fastened to said sheet of fabric near the upper edge portion thereof, a grommet extending through the fabric and the at least one stiffening member located at one end of the backing strip, handle means passing through said grommet at the end of said backing strip and fabric, a channel mounted above a window, a plurality of slide carriers in a track on said channel, said handle means being affixed securely to one end slide carrier, said fasteners engaging in sockets in the remaining slide carriers, and means for limiting movement of said slide carriers relative to said channel, said brake means frictionally engaging said track to restrain movement of said end of the fabric, and said three parts of each stiffening member forming a threesided pleat at the ends of said fabric are brought closer together.

19. A drapery comprising a sheet of fabric material, a narrow backing strip, a plurality of stiffening members attached to said backing strip in spaced apart relationship, each stiffening member being divided along vertical lines into three parts, said backing strip and plural stiffening members being secured to said sheet of material along the upper edge portion thereof, and means carried by said middle part of said three parts of the stiffening members for attaching said drapery to a track.

20. A method of making a drapery comprising cutting a sheet of fabric to size, forming a backing member by cutting from a sheet of material that is stiffer than the fabric a narrow band that is of a length equal to the width of said fabric, forming two hinge means the length of a sheet of plastic material, forming stiffening members by cutting said sheet of plastic into short lengths equal to the width of said band of backing material, placing and dielectrically attaching a plurality of said stiffening members to said backing member in spaced apart relationship, passing fasteners through the intermediate ones of said stiffening members, stitching said combined backing member and stiffening members to one edge portion of said fabric, forming a brake means by bending a strip of material in a loop, and passing a grommet through the fabric, backing member and endmost stiffening members and trapping one of said brake means to said grommet by upsetting the end of said grommet.

* * * * *

UNITED STATES PATENT AND TRADEMARK OFFICE

CERTIFICATE OF CORRECTION

PATENT NO. : 4,230,171

DATED : October 28, 1980

INVENTOR(S) : George H. Baker, Sr.

It is certified that error appears in the above-identified patent and that said Letters Patent are hereby corrected as shown below:

Column 2, line 33, after "top" insert --plan--;
Column 4, line 42, change "10" to --70--;
Column 8, line 52, change "threesided" to --three-sided--; and
Column 9, line 14, change "threesided" to --three-sided--.

Signed and Sealed this

*Twenty-eighth* Day of *April 1981*

[SEAL]

*Attest:*

RENE D. TEGTMEYER

*Attesting Officer*

*Acting Commissioner of Patents and Trademarks*